US008257105B2

(12) United States Patent
Schmidt et al.

(10) Patent No.: US 8,257,105 B2
(45) Date of Patent: Sep. 4, 2012

(54) LOCKING SYSTEM FOR MULTIPART HOUSINGS

(75) Inventors: Martin Schmidt, Luebbecke (DE); Frank Quast, Bielefield (DE); Thomas Gieschke, Loehne (DE)

(73) Assignee: Harting Electric GmbH & Co. KG (DE)

( * ) Notice: Subject to any disclaimer, the term of this patent is extended or adjusted under 35 U.S.C. 154(b) by 171 days.

(21) Appl. No.: 12/858,326

(22) Filed: Aug. 17, 2010

(65) Prior Publication Data

US 2011/0062034 A1 Mar. 17, 2011

(30) Foreign Application Priority Data

Sep. 11, 2009 (DE) ..... 10 2009 041 371

(51) Int. Cl.
*H01R 13/627* (2006.01)

(52) U.S. Cl. ..... 439/352

(58) Field of Classification Search ..... 220/23.83, 220/23.87, 500, 529, 534, 540, 545–546, 220/550, 553, 4.01, 600, 23.89, 288, 326; 439/147, 352, 372, 258, 460, 157; 292/80, 292/81, 86, 87, 137, 138, 145, 289, 292, 292/295; 206/1.5

See application file for complete search history.

(56) References Cited

U.S. PATENT DOCUMENTS

| | | | | |
|---|---|---|---|---|
| 5,183,408 | A * | 2/1993 | Hatagishi | 439/147 |
| 6,056,577 | A * | 5/2000 | Blanchet | 439/352 |
| 7,175,464 | B2 * | 2/2007 | Ferderer et al. | 439/352 |
| 7,785,131 | B2 * | 8/2010 | Ferderer et al. | 439/372 |

* cited by examiner

*Primary Examiner* — Charles A Fox
*Assistant Examiner* — Brijesh Patel
(74) *Attorney, Agent, or Firm* — Hayes Soloway P.C.

(57) ABSTRACT

In order to lock a housing that consists of at least two parts, particularly a plug connector housing, a locking system that functions similar to a toggle lever mechanism is provided. In this case, a locking plate is arranged within a shell-shaped sliding element to both sides of a first and a second housing half and movably held on bearing pins on the second housing half, wherein latches are provided on the first housing half and engage into window openings provided in the locking plate for this purpose when the sliding element is displaced into its locking position in order to hold together the two housing halves.

25 Claims, 3 Drawing Sheets

LOCKING SYSTEM FOR MULTIPART HOUSINGS

BACKGROUND OF THE INVENTION

1. Field of the Invention

The invention pertains to a locking system for multipart housings with a first housing half and a second housing half, and with a locking plate that engages on both housing halves, surrounded by a sliding element.

A locking system of this type is required for holding together two housing halves in a separable fashion.

2. Description of the Related Art

Conventional locking systems that are based on toggle levers normally operate with two articulation systems, namely with a claw-like locking hook that is connected to the actual pivoted lever by means of an articulation. This articulation is situated below the suspension point of a clip on the housing. Depending on the design, the locking hook can be pressed against a stop of the clip by a return spring. During mating, the locking hook snaps over the catch hook and is tensioned due to the actuation of the pivoted lever. In this case, the pivoted lever is pressed in the direction of the housing and not in the direction of a mated housing as it is usually the case.

Such a locking system requires two clip elements with bearing points that correspond to one another. Due to the high forces in the pivoting and suspension points, the components need to be realized in a correspondingly solid fashion. After attaching the housing, a locking hook also needs to be placed around the latch before the pivoted lever is actuated.

SUMMARY OF THE INVENTION

The invention therefore is based on the objective of developing a mechanically simple locking system for separably connecting at least two housing halves that locks the housing halves under tension by means of a toggle lever-like principle.

This objective is attained in that the elastic locking plate features several retaining tabs, in that openings provided in the retaining tabs correlate with latches on the first housing half and with bearing pins on the second housing half, and in that the locking plate is bent by means of a displaceable sliding element—that surrounds the locking plate—such that said bending causes the two housing halves to be unlocked or locked.

The invention concerns a housing, particularly a connector housing, that consists of two housing halves and features a locking system formed by a sliding element, within which an elastic locking plate is arranged.

In this case, two sliding elements are symmetrically arranged on both sides of the connector housing.

The locking plate features several openings and is movably supported on the bearing pins of the lower housing half, wherein the locking plate is connected to the upper housing half by means of latches and the two housing halves are elastically pressed against one another in the locked state.

In order to disengage the lock, the sliding element is pulled toward the upper housing half in the removing direction, wherein the angled ends on the lower part of the locking plate slide along a guide ramp in the sliding element and pull the locked part of the locking plate away from the latch.

In this case, the locking plate that is formed by three retaining tabs held together on a cross brace is bent apart under tension from its otherwise common surface in a V-shaped fashion between the outer retaining tabs that are held on the bearing pins and the centrally arranged locking tab.

In addition, corresponding contours are moulded into the sliding element and ensure a reliable guidance of the locking plate during locking and unlocking processes together with complementary angular bends on the locking plate.

When locking the two housing halves, the sliding element is displaced in the mating direction, wherein the window-like openings of the locking plate are ultimately guided over the catch pin on the upper housing half by a correspondingly shaped semicircular contour of the sliding element. During the further displacement, the lower region of the locking plate is relieved such that the plate that was previously bent apart reassumes its original plane shape.

In this case, the distance between the two openings for the bearing pin and the latch is chosen such that the two housing halves are pressed together in the locked state by the tension of the locking plate.

This is also advantageous with respect to the fact that such a locking device makes it possible to achieve a tight seal against environmental influences. According to another embodiment, it is proposed that the lock is not arranged on the lower, possibly rigid housing half as described above, but rather on the movable upper housing half. However, the sliding direction should correspond to the mating direction of the upper housing in this case.

It is advantageous that the number of components is significantly reduced and that the articulations realized in the form of pivot points in a toggle lever-based lock are replaced with components with easily mountable contact surfaces. A conventional lateral pivoting movement of a spring clip is advantageously replaced with a sliding movement that corresponds to the mounting direction of the movable housing half.

BRIEF DESCRIPTION OF THE DRAWINGS

One embodiment of the invention is illustrated in the figures and described in greater detail below in which.

DESCRIPTION OF THE PREFERRED EMBODIMENTS

Figure 1:
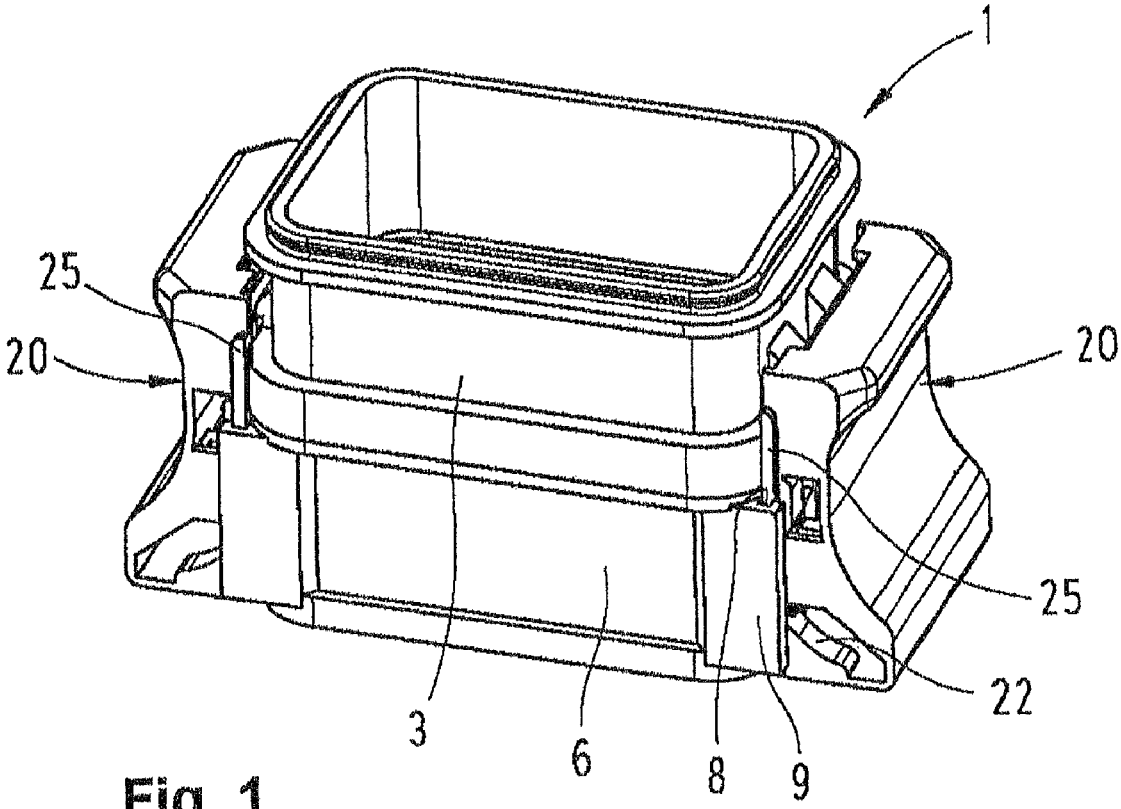
FIG. 1 is a perspective representation of two locked housing halves with two sliding elements.

FIG. 1 shows a side view of a housing 1 with two housing parts, namely a first housing half 3 and a second housing half 6. In this case, the top of the housing part 3 is still open because a housing cover is subsequently attached thereto.

The two housing halves can be connected by means of a locking system in the form of an ergonomically shaped sliding element 20, within which a locking plate 10 is arranged on latches 4 and bearing pins 7 of the housing halves 3, 6.

The sliding element 20 is guided with the aid of guide rails 25 that are laterally moulded thereon and engage into guide grooves 8 in sidewalls 9 that are laterally moulded onto the lower, second housing half.

The locking plate 10 is realized in the form of a rectangular punched component that comprises three adjacently arranged tabs 11, 13, 11, wherein the tabs are held together by means of a cross brace 15 provided on one of the narrow side thereof.

Figure 2:
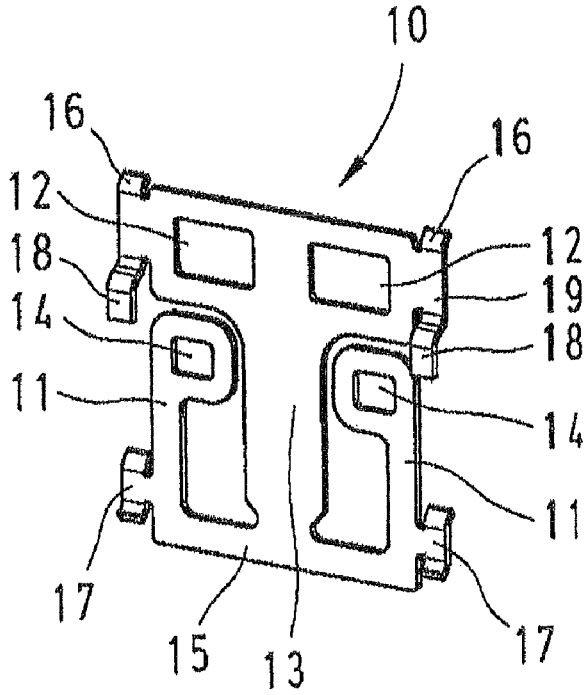
FIG. 2 is a locking plate.

The locking plate 10 is illustrated in FIG. 2 and divided into three tab-like parts.

In this case, the central locking tab 13 features two adjacently arranged rectangular window openings 12 while the two shorter retaining tabs 11 arranged to the right and to the left of the central locking tab 13 respectively feature an opening 14 that is arranged underneath the window openings 12.

The outer retaining tabs 11 are realized shorter because the central locking tab 13 is realized in a T-shaped fashion above the openings 14 and therefore has the same width as the lower cross brace 15, on which the three retaining tabs 11, 13, 11 are connected to one another.

In addition, S-shaped ends 17 are bent out of the plane of the locking plate on the lower corner regions of the shorter retaining tabs 11.

The lateral regions of the T-shaped part of the locking tab 13 respectively feature an edge region 19, on one end of which a bent end piece 16 is formed and on the other end of which an arm 18 that extends parallel to the plane of the edge region is respectively arranged.

Figure 3:
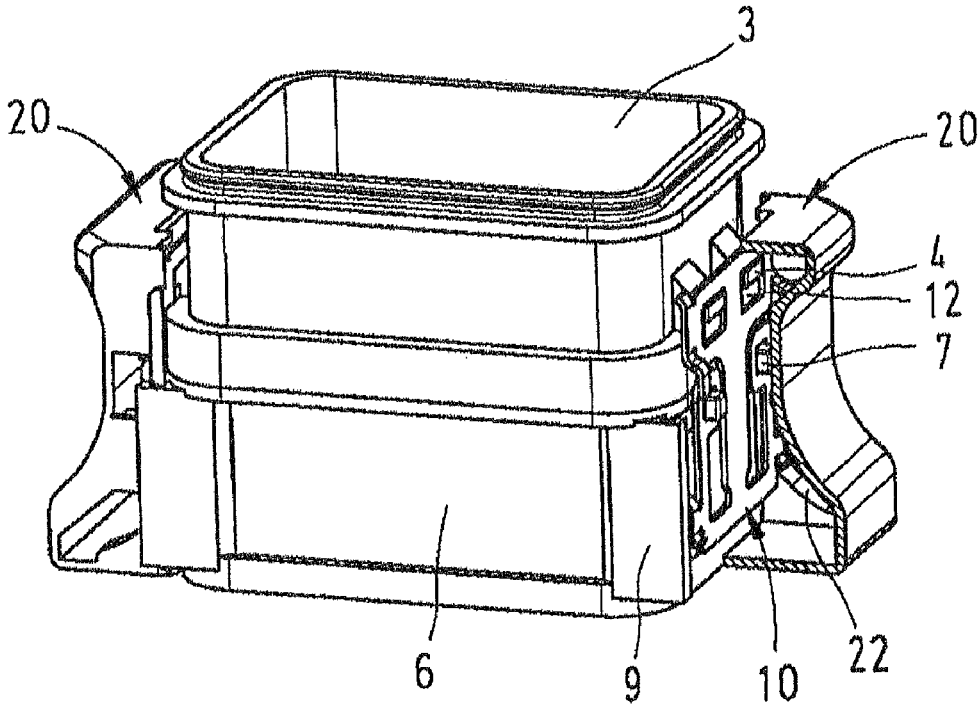
FIG. 3 is a perspective representation of two housing halves with a partially sectioned sliding element in the locked state.

FIG. 3 shows an isometric representation of the locking system with the two housing halves 3, 6 in the locked position, wherein the locking plate 10 is visible due to the partially sectioned sliding element 20.

According to this figure, the outer walls of the first housing half 3 and of the second housing half 6 respectively feature two pins.

In this case, latches 4 are moulded onto the upper, first housing half 3 and bearing pins 7 are moulded onto the lower, second housing half 6.

The pins are inserted into the openings 12 and 14 of the locking plate 10 that is aligned parallel to the outer walls, wherein the two housing halves 3, 6 are held together under tension.

Figure 4:
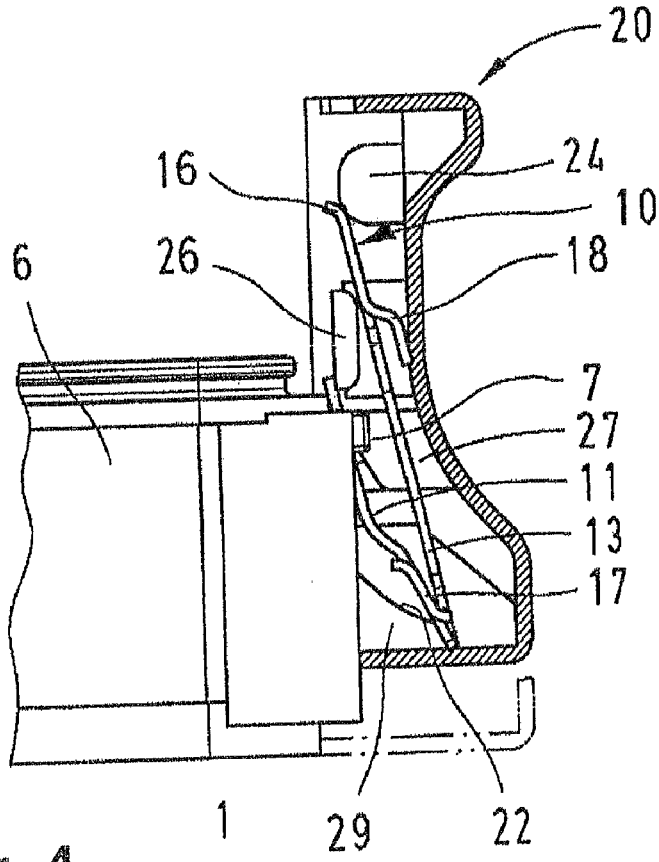
FIG. 4 is a side view of the housing halves with a sectioned sliding element in the unlocked state.

FIG. 4 shows an unlocked position of the two housing halves 3, 6 in the form of a side view with the partially sectioned sliding element 20. For this purpose, the sliding element 20 is pulled upward such that the S-shaped ends 17 of the locking plate 10 that are respectively bent away from the housing on the corner regions of the cross brace 15 are already moved away laterally by means of the ramps 22 integrated into the lateral regions of the sliding element 20 and slide on near the bottom of the sliding element.

In this case, the central locking tab 13 is pulled away from the outer retaining tabs 11 such that they are spread apart in a scissor-like fashion—wherein the cross brace 15 ultimately forms the pivot point between the central locking tab 13 and the outer retaining tabs 11. However, the openings 14 of the outer retaining tabs 11 always remain on the bearing pins 7 of the lower, second housing half 6 while the central locking tab 13 is bent away into the interior of the shell-shaped sliding element 20 such that it releases the latch 4 of the upper, first housing half 3.

The bending of the locking plate 10 is limited with an upper semicircular contour 24 on the side wall of the sliding element, as well as an arm 18 that is bent out of the locking plate 10 and comes in contact with the concavely shaped wall of the sliding element 20.

In this case, the locking plate 10 is guided on the side walls of the sliding element 20 between the upper contour 24 and a center contour 26.

The angle of the spread-apart tabs 11, 11 and 13 changes during the locking process, in which the sliding element 20 is pushed downward in this illustration. The spread-apart tabs are pushed together again due to the fact that the end pieces 17 that slide onto the lower ramp 22 reduce the tab angle and the cross brace 15 is gradually guided toward side wall of the lower, second housing half 6.

The edge regions 19 on the upper part of the locking plate 10 are simultaneously pushed along on the elongated center contour 26 and on the semicircular upper contour 24 until a bend in the arm 18 rests against the contour 26.

This causes the locking tab 13 to be pressed toward the first housing half 3 such that the window openings 12 receive the latches 4.

Since the window openings 12 of the central locking tab 13 have already received the latches 4, the locking plate 10 assumes a slightly inclined position relative to the side walls during the final downward displacement of the sliding element 20 and the two housing halves 3 and 6 are pressed together into a locked state, in which they are under tension, due to the toggle lever effect of the locking plate 10 that now becomes effective.

Figure 5:
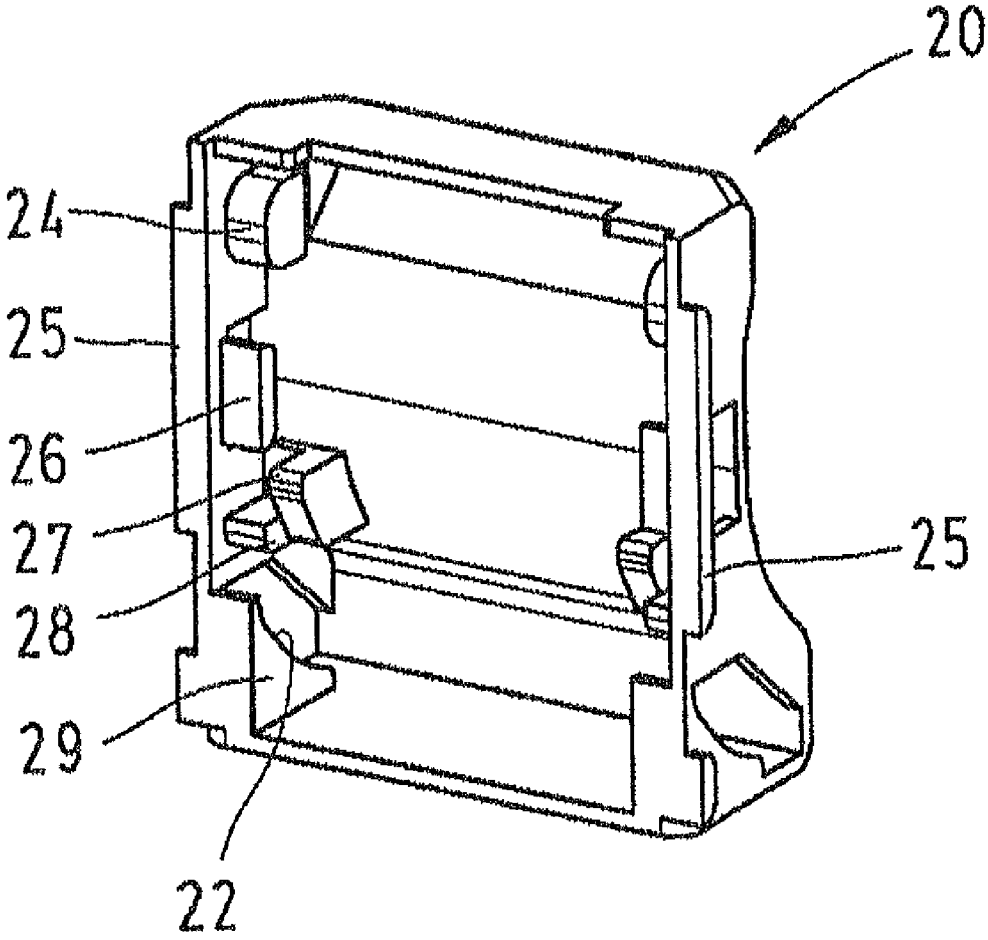
FIG. 5 is a perspective interior view of the sliding element.

FIG. 5 shows the interior of the sliding element 20 in the form of a perspective representation.

This figure shows several attachments that are moulded onto the side walls of the sliding element 20. These attachments consist of the lateral guide rails 25, by means of which the sliding element is displaceably held on the second housing half 6, the lower ramp 22, onto which the sliding element 20 slides with the lower S-shaped end piece 17, as well as the important attachments 24, 26, 27 and 28.

The arm 18 is guided between the semicircular upper contour 24 and the elongated center contour 26 with the adjacent edge region 19 of the central locking tab 13 during the displacement of the locking plate 10.

The pressing attachment 27 constantly presses the retaining tabs 11 against the second housing half 6 such that the bearing pins 7 cannot slide out of the openings 14 of the retaining tabs and it is ensured that the locking plate 10 is under tension in the unlocked state of the sliding element 20. During the displacement to lock the two housing halves—in this case downward—the locking plate 10 relaxes and abuts the center contour 26 beyond an imaginary slack point. In this case, the surface of the contour 26, on which the holding tab 11 now rests in an aligned fashion, rests on the housing half 6 a short distance above the ramp 22 slightly farther from the contact point of the lower, angled end pieces 17—referred to the lateral distance to the wall of the housing half 6.

A contour 28 that is moulded on between the side wall and the pressing attachment 27 serves for laterally guiding the outer retaining tabs 11—similar to the inner wall 29 of the ramp 22.

During the locking process, the position of the locking plate 10 is ultimately aligned on the side walls with a slight incline, namely inward from the first, upper housing half 3 toward the second, lower housing half 6.

What is claimed is:

1. A locking system for multipart housings with a first housing half and a second housing half, and with an elastic locking plate that engages on both housing halves, surrounded by a displaceable sliding element, wherein the elastic locking plate features several tabs, in that openings provided in the tabs correlate with latches on the first housing half and with bearing pins on the second housing half, and wherein the tabs of the locking plate are bent using a displaceable sliding element—that surrounds the locking plate—such that said bending causes the two housing halves to be unlocked or locked, wherein the several tabs of the elastic locking plate comprise comprise three adjacently arranged tabs, including a central locking tab and two outer retaining tabs, wherein one side of each of said tabs is held on a cross brace, wherein the outer retaining tabs are shorter than the central locking tab, wherein window openings are provided in the outer retaining tabs and supported on bearing pins on the second housing half, and wherein the central locking tab features window openings that engage on at least one latch on the first housing half.

2. The locking system according to claim 1, wherein the displaceable sliding element is realized in the form of an open hollow body with a rectangular basic shape and a concave outer surface and displaceably held using lateral guide rails that engage into corresponding guide grooves in the second housing half.

3. The locking system according to claim 1, wherein the displaceable sliding element features in its inner region a lower ramp, on which a lower end piece shaped out of the cross brace of the elastic locking plate rests in a displaceable fashion.

4. The locking system according to claim 1, wherein the displaceable sliding element has a semicircular contour on an inner lateral surface in order to guide an upper, angled end piece of the elastic locking plate.

5. The locking system according to claim 1, wherein the displaceable sliding element features on an inner lateral surface a ramp, which serves to disengage the elastic locking plate from the latch of the first housing half during the displacement of the displaceable sliding element.

6. The locking system according to claim 1, wherein the central locking tab features an angled arm extending parallel to the two outer retaining tabs moulded onto the central locking tab of the elastic locking plate.

7. The locking system according to claim 1, wherein the central locking tab is deflected between an elongated center contour and an inner convex contour on the displaceable sliding element together with the angled arm during displacement of the displaceable sliding element such that the first and second housing halves are unlocked.

8. The locking system according to claim 6, wherein the displaceable sliding element features a semicircular contour which presses against an edge region of the central locking tab and presses the central locking tab against the first housing during the locking process such that the latches penetrate into the openings in order to be locked therein.

9. The locking system according to claim 1, wherein the outer retaining tabs of the elastic locking plate constantly press against the second housing half using a pressing attachment in the displaceable sliding element such that the bearing pins are constantly guided within the window openings.

10. A locking system for multipart housings with a first housing half and a second housing half, and with an elastic locking plate that engages on both housing halves, surrounded by a displaceable sliding element, wherein the elastic locking plate features several tabs, in that openings provided in the tabs correlate with latches on the first housing half and with bearing pins on the second housing half, and wherein the tabs of the elastic locking plate are bent using said displaceable sliding element—that surrounds the elastic locking plate—such that said bending causes the two housing halves to be unlocked or locked, wherein the displaceable sliding element is realized in the form of an open hollow body with a rectangular basic shape and a concave outer surface and displaceably held using lateral guide rails that engage into corresponding guide grooves in the second housing half.

11. The locking system according to claim 10, wherein the displaceable sliding element features in its inner region a lower ramp, on which a lower end piece shaped out of the cross brace of the elastic locking plate rests in a displaceable fashion.

12. The locking system according to claim 10, wherein the displaceable sliding element has a semicircular contour on an inner lateral surface in order to guide an upper, angled end piece of the elastic locking plate.

13. The locking system according to claim 10, wherein the displaceable sliding element features on an inner lateral surface a ramp, which serves to disengage the elastic locking plate from the latch of the first housing half during the displacement of the displaceable sliding element.

14. The locking system according to claim 10, wherein the elastic locking plate includes a central locking tab arranged between two outer retaining tabs, and wherein the central locking tab features an angled arm extending parallel to the outer retaining tabs and moulded onto the central locking tab of the elastic locking plate.

15. The locking system according to claim 14, wherein the central locking tab is deflected between an elongated center contour and an inner convex contour on the displaceable sliding element together with the angled arm during displacement of the displaceable sliding element such that the first and second housing halves are unlocked.

16. The locking system according to claim 14, wherein the displaceable sliding element features a semicircular contour which presses against an edge region of the central locking tab and presses the central locking tab against the first housing during the locking process such that the latches penetrate into the openings in order to be locked therein.

17. The locking system according to claim 10, wherein the elastic locking plate includes a central locking tab and two outer retaining tabs, provided with window openings, wherein the outer retaining tabs constantly press against the second housing half using a pressing attachment in the displaceable sliding element such that the bearing pins are constantly guided within the window openings.

18. A locking system for multipart housings with a first housing half and a second housing half, with an elastic locking plate that engages on both housing halves, surrounded by a displaceable sliding element, wherein the elastic locking plate features several tabs, in that openings provided in the tabs correlate with latches on the first housing half and with bearing pins on the second housing half, and wherein the tabs of the elastic locking plate are bent using said displaceable sliding element—that surrounds the elastic locking plate—such that said bending causes the two housing halves to be unlocked or locked, and wherein the displaceable sliding element has a semicircular contour on an inner lateral surface in order to guide an upper, angled end piece of the elastic locking plate.

19. The locking system according to claim 18, wherein the displaceable sliding element is realized in the form of an open hollow body with a rectangular basic shape and a concave outer surface and displaceably held using lateral guide rails that engage into corresponding guide grooves in the second housing half.

20. The locking system according to claim 18, wherein the displaceable sliding element features in its inner region a lower ramp, on which a lower end piece shaped out of the cross brace of the elastic locking plate rests in a displaceable fashion.

21. The locking system according to claim 18, wherein the displaceable sliding element features on an inner lateral surface a ramp, which serves to disengage the elastic locking plate from the latch of the first housing half during the displacement of the displaceable sliding element.

22. The locking system according to claim 18, wherein the elastic locking plate includes a central locking tab arranged between two outer retaining tabs, and wherein the central locking tab features an angled arm extending parallel to the outer retaining tabs and moulded onto the central locking tab of the elastic locking plate.

23. The locking system according to claim 18, wherein the central locking tab is deflected between an elongated center contour and an inner convex contour on the displaceable sliding element together with the angled arm during displacement of the displaceable sliding element such that the first and second housing halves are unlocked.

24. The locking system according to claim 22, wherein the displaceable sliding element features a semicircular contour which presses against an edge region of the central locking tab and presses the central locking tab against the first housing during the locking process such that the latches penetrate into the openings in order to be locked therein.

25. The locking system according to claim 18, wherein the elastic locking plate includes a central locking tab and two outer retaining tabs, provided with window openings, wherein the outer retaining tabs of the elastic locking plate constantly press against the second housing half using a pressing attachment in the displaceable sliding element such that the bearing pins are constantly guided within the window openings.

* * * * *